US007745752B2

(12) United States Patent
Kotera

(10) Patent No.: US 7,745,752 B2
(45) Date of Patent: Jun. 29, 2010

(54) MOUNTING OF AN OPERATION KEY WITHIN AN OPERATION PANEL

(75) Inventor: Shinichi Kotera, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 405 days.

(21) Appl. No.: 11/826,678

(22) Filed: Jul. 17, 2007

(65) Prior Publication Data

US 2009/0260968 A1 Oct. 22, 2009

(30) Foreign Application Priority Data

Jul. 19, 2006 (JP) ..... 2006-196308

(51) Int. Cl.
*H01H 13/70* (2006.01)

(52) U.S. Cl. ..... 200/344; 400/490; 400/491

(58) Field of Classification Search ..... 200/345, 200/344; 400/490, 491, 491.2, 495, 495.1
See application file for complete search history.

(56) References Cited

U.S. PATENT DOCUMENTS 3,890,480 A * 6/1975 Berling et al. ..... 200/302.2
4,362,408 A * 12/1982 Cordes et al. ..... 400/481
4,764,770 A * 8/1988 Church ..... 200/5 A
5,391,006 A * 2/1995 Danziger ..... 400/488
6,019,530 A * 2/2000 Lanzetta et al. ..... 400/491.1
6,821,036 B2 * 11/2004 Horiuchi ..... 400/490
6,940,030 B2 * 9/2005 Takeda et al. ..... 200/343
7,138,588 B2 * 11/2006 Soumi ..... 200/5 A

FOREIGN PATENT DOCUMENTS

JP 11-306903 11/1999
JP 2000-276963 10/2000

* cited by examiner

*Primary Examiner*—Edwin A. Leon
*Assistant Examiner*—Vanessa Girardi
(74) *Attorney, Agent, or Firm*—Smith, Gambrell & Russell, LLP

(57) ABSTRACT

An operation key 3 is fitted in a guide hole 4 of an operation section cover 2 while making contact with support pieces 12 of a film member 10*a*. Thus, the support pieces 12 are pressed, widened, and then bent by an operation section 3*b*, thus sandwiching the support pieces 12 between the operation section 3*b* and the guide hole 4. Here, the film member 10*a* has an elastic force; thus, the operation key 3 is positioned at a substantially vertical center of the guide hole 4 by restoring forces of the support pieces 12.

8 Claims, 6 Drawing Sheets

MOUNTING OF AN OPERATION KEY WITHIN AN OPERATION PANEL

This application is based on Japanese Patent Application No. 2006-196308 filed on Jul. 19, 2006, the contents of which are hereby incorporated by reference.

BACKGROUND OF THE INVENTION

1. Technical Field of the Invention

The invention relates to an operation panel arranged outside an electronic device and used for various input operations and also to provide an electronic device provided with such an operation panel.

2. Description of Related Arts

An electronic device in an image forming apparatus or the like is typically loaded with an operation panel including operation keys for input operations and a display section for displaying a working state of the apparatus. FIG. 6 is an external perspective view of a conventional operation panel. FIG. 7 is an exploded perspective view of the conventional operation panel as viewed from the rear side thereof. FIG. 8 is an enlarged view of an operation key portion of the conventional operation panel. The operation panel 1 has a control board, not shown, arranged inside an operation section cover 2, on the front surface of which a plurality of operation keys 3 for inputting various commands to the control board and a display section 5 for displaying a working state of the apparatus are provided.

The operation key 3 has a flange section 3*a* formed larger than a guide hole 4 and an operation section 3*b* projecting toward the front side of the operation section cover 2 via the guide hole 4. On the rear surface of the flange section 3*a*, a connecting terminal 6 is provided. The user can press the operation section 3*b* to thereby bring it into contact with a contact on the control board or separate therefrom. In each of the flange section 3*a*, two boss holes 8 are formed which respectively fit with bosses 7 formed on the rear surface of the operation section cover 2.

In such an operation panel 1, a small difference between the inner dimension of the guide hole 4 and the outer dimension of the operation key 3 has created, for example, a problem that pressing an edge of the operation key 3 or pressing the operation key 3 diagonally by the user causes interference between the operation key 3 and the edge of the guide hole 4, bringing the operation key 3 into a nonoperational state (locked state). Thus, a method of providing a relatively large difference between the inner dimension of the guide hole 4 and the outer dimension of the operation key 3 to avoid the locking of the operation key 3 has been adopted. However, this method encounters a problem that shift of the operation key 3 from the center of the guide hole 4 leaves an outstanding clearance between the operation key 3 and the guide hole 4, thus deteriorating the appearance of the device.

In recent years, especially adoption of universal design that can be used regardless of age and sex, presence or absence of disability, and individual capabilities has increased the number of electronic devices whose operability is enhanced by tilting an entire operation panel. In the operation panel 1 loaded in such an electronic device, the operation key 3 moves to the lower end of the guide hole 4 by its own weight, and as shown in FIG. 8, a clearance 9*a* between the operation key 3 and the upper end of the guide hole 4 is wider than a clearance 9*b* between the operation key 3 and the lower end of the guide hole 4.

As a method of fitting an operation key to an operation section cover, Patent document 1 discloses, for example, an operation panel in which a clearance between an operation button and a frame holding the operation button is provided and the operation button is positioned by a hole formed in an external cover fixed on the frame. Patent document 2 discloses an operation button holding mechanism including an elastic member biasing a flange section of a first operation button and an elastic sheet formed into a thin plate extending from the elastic member, in which mechanism supporting can be achieved by biasing second operation buttons having flange sections of different thicknesses.

However, the method of patent document 1 performs positioning of the operation button with the external cover hole. Thus, this method requires a small difference between the inner dimension of the external cover hole and the outer dimension of the operation button, thus causing a risk of interference and thus locking between the external cover and the operation button. Moreover, the method of patent document 2 makes it easy to perform positioning in the operation direction of the operation button, that is, the direction vertical to the operation surface. However, the method of patent document 2 does not consider positioning in the direction horizontal to the operation surface, thus resulting in failure to prevent locking of the operation button and deterioration in design caused by displacement of the operation button.

[Patent Document 1] JP-A-H11-306903

[Patent Document 2] JP-A-2000-276963

SUMMARY OF THE INVENTION

The present invention addresses the problem described above, and it is an object of the invention to provide an operation panel which does not encounter locking of an operation key and which has a less outstanding clearance between the operation key and an operation section cover with simple configuration and also to provide an electronic device provided with such an operation panel.

To achieve the object described above, one aspect of the invention refers to an operation panel including: an operation key making contact with or separating from a contact on a control board; and an operation section cover provided with a guide hole from which part of the operation key projects. In the operation panel, input operation on an electronic device is performed by pressing the operation key. In the operation panel, a flexible film member is fitted to a rear surface of the operation section cover. The film member has: a through hole coinciding with the guide hole; and a plurality of support pieces formed at opposing edges of the through hole and elastically deformed by insertion of the operation key in the through hole to thereby make contact with a side surface of the operation key.

This configuration, in which the operation key is positioned by elastic forces of the plurality of support pieces provided in the film member without making contact with the edges of the guide hole, is free from a risk of deterioration in appearance caused by providing a sufficient clearance between the operation key and the guide hole and also reliably prevents locking of the operation key caused by its interference with the edge of the guide hole.

In the operation panel with the configuration described above, the support pieces may be provided in at least one pair so that tip ends thereof oppose each other.

This configuration can provide uniform elastic forces acting from the support pieces on the operation key and position the operation key at the substantially vertical center of the guide hole.

In the operation panel with the configuration described above, the support pieces may be provided in at least two pairs so that the support pieces make contact with the side surface of the operation key from different directions.

This configuration permits preventing displacement of the operation key 3 in different directions and thus providing a uniform clearance between the operation key and the guide hole at the entire circumference, thus resulting in the operation panel with even better appearance.

In the operation panel with the configuration described above, the film member may have a plurality of the through holes.

This configuration permits arrangement of the film member with respect to a plurality of the guide holes at a time, thus improving performance in operation of fitting the film member to the operation section cover.

In the operation panel with the configuration described above, the film member may have an opening formed into a shape substantially identical to a shape of a boss of the operation section cover. The opening may be located at a position coinciding with the boss.

This configuration permits avoiding interference between a boss section of the operation section cover and the film member and also easily positioning the film member with respect to the operation section cover.

In the operation panel with the configuration described above, the film member may be formed of a polyethylene terephthalate film.

This configuration, by forming the film member with the polyethylene terephthalate film having small frictional resistance and an excellent elastic force, reliably supports the operation key by the support pieces and also makes it smooth to perform operation of pressing the operation key.

Another aspect of the invention refers to an electronic device loaded with the operation panel with the configuration described above.

This configuration provides the electronic device which does not encounter locking of the operation key and also which is excellent in design.

In the electronic device with the configuration described above, the operation panel may be so fitted as to be tilted at a predetermined angle with respect to a horizontal plane, and the support pieces may make contact with the side surface of the operation key which side surface is vertically oriented with respect to the tilt of the operation panel.

This configuration, even in a case of tilted arrangement of the operation panel, permits preventing widening of the clearance on the top side caused by movement of the operation key under the influence of own weight of the operation key, thus improving the operability of the operation panel and providing the electronic device compatible with a wide variety of designs.

DETAILED DESCRIPTION OF THE PREFERRED EMBODIMENTS

Figure 1:
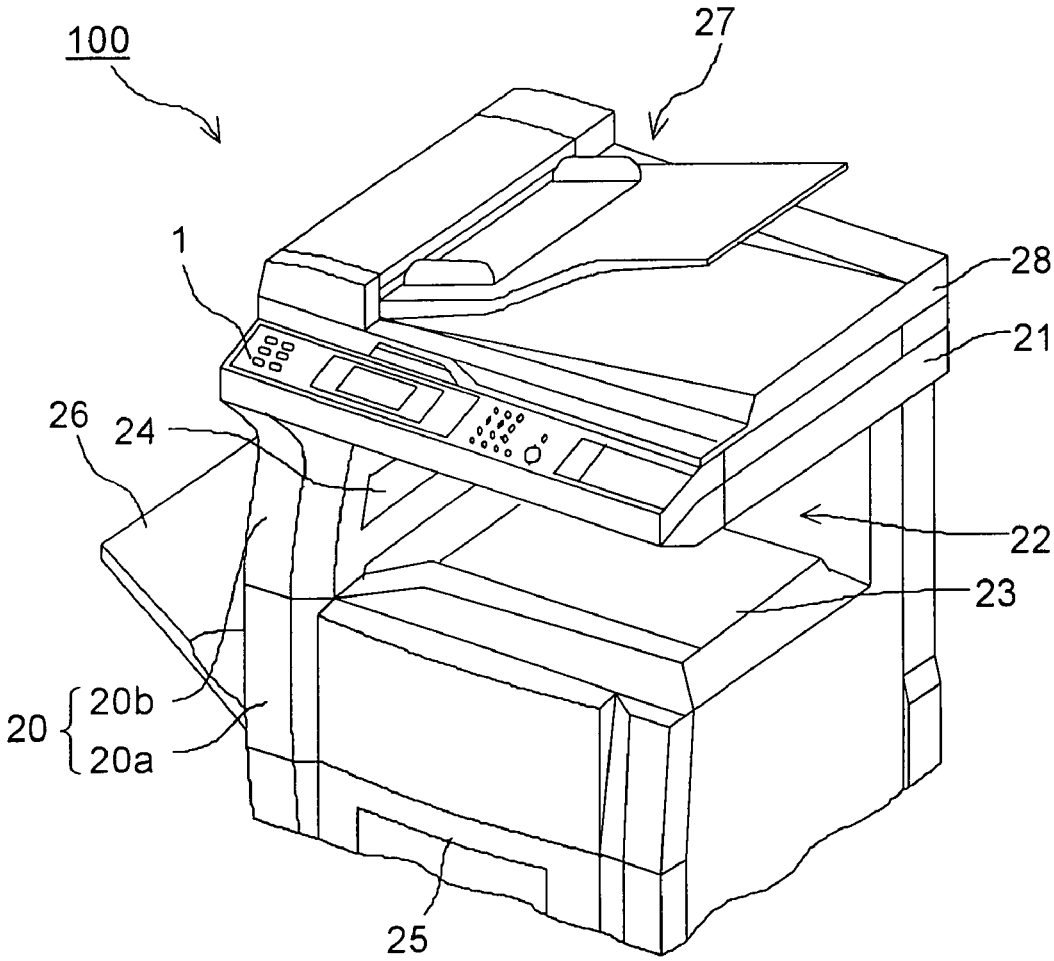
FIG. 1 is an external perspective view of an image forming apparatus loaded with an operation panel according to the present invention.

Hereinafter, the embodiment of the invention will be described with reference to the accompanying drawings. FIG. 1 is a perspective view showing external configuration of an image forming apparatus loaded with an operation panel of the present invention. In FIG. 1, the image forming apparatus 100 is composed of a body housing 20 and an upper housing 21 disposed on the top of the body housing 20. In the upper housing 21, an image reading section for reading an image of an original document as an electrical signal is provided, while various mechanisms for forming an image on paper based on an electrical signal of a read image of an original document are provided in the body housing 20.

The body housing 20 is composed of a lower housing 20*a* and a coupled housing 20*b* located thereabove and along the left side thereof and coupled to the upper housing 21. The lower housing 20*a* is provided with: a paper feed mechanism for feeding paper, an image formation section for forming a toner image on paper, a fixing section for fixing a toner image on paper, and the like. On the other hand, the coupled housing 20*b* is provided with a paper discharge section for transporting and then discharging paper already subjected to fixation.

On the right side of the coupled housing 20*b* immediately below the upper housing 21, an in-body paper discharge space 22 is formed which opens widely toward the right and front of the apparatus. In this in-body paper discharge space 22, a paper discharge tray 23 is provided for receiving and loading paper discharged horizontally from a paper discharge port 24 provided on the right side surface of the coupled housing 20*b*. At the bottom of the lower housing 20*a*, a paper feed cassette 25 is disposed which stores paper of various sizes and which can be taken out and in from the front. On the bottom left side surface of the lower housing 20*a*, an openable and closable manual paper tray 26 is provided which is pulled down when necessary.

Disposed on the top surface of the upper housing 21 are an original document loading base, not shown, formed of a transparent glass plate and an operation panel 1 projecting to the front of the apparatus. Further, above the upper housing 21, an original document holder 28 loaded with a document transport device 27 for transporting an original document to an image reading position in the original document loading base is supported in an openable and closable manner by a hinge, not shown, formed on the rear surface of the upper housing 21.

Figure 2:
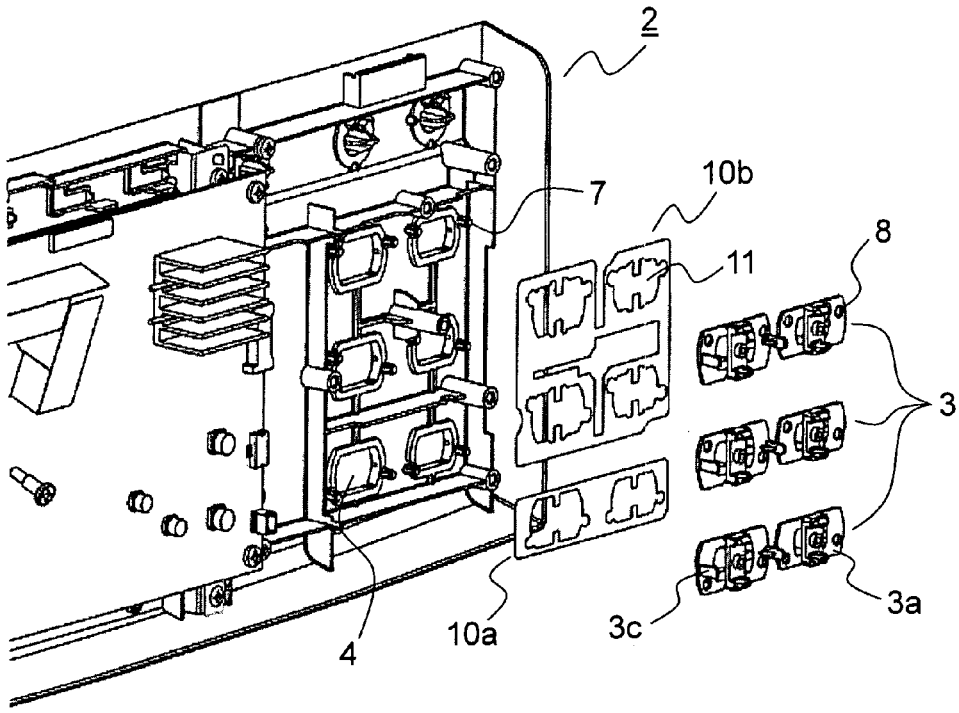
FIG. 2 is an exploded perspective view of the operation panel of the invention as viewed from a rear side thereof.
Figure 6:
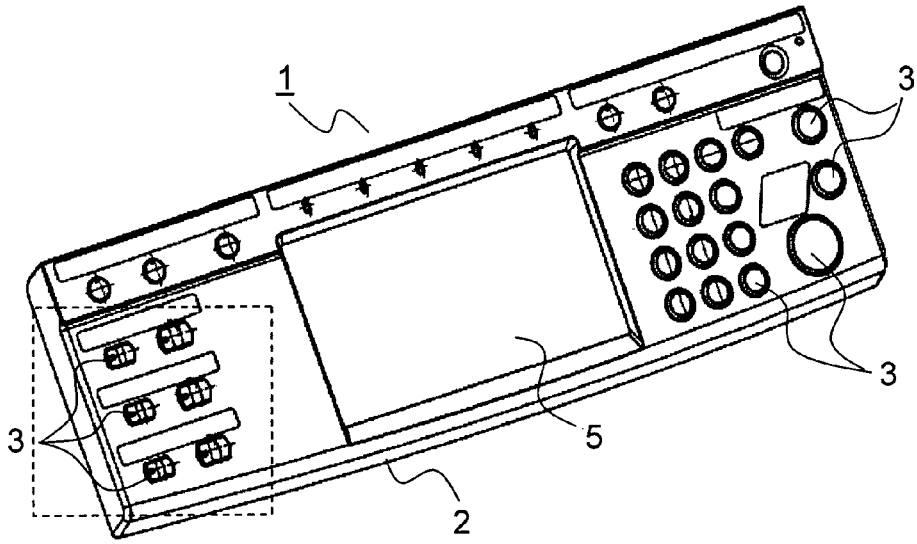
FIG. 6 is an external perspective view of a conventional operation panel.
Figure 7:
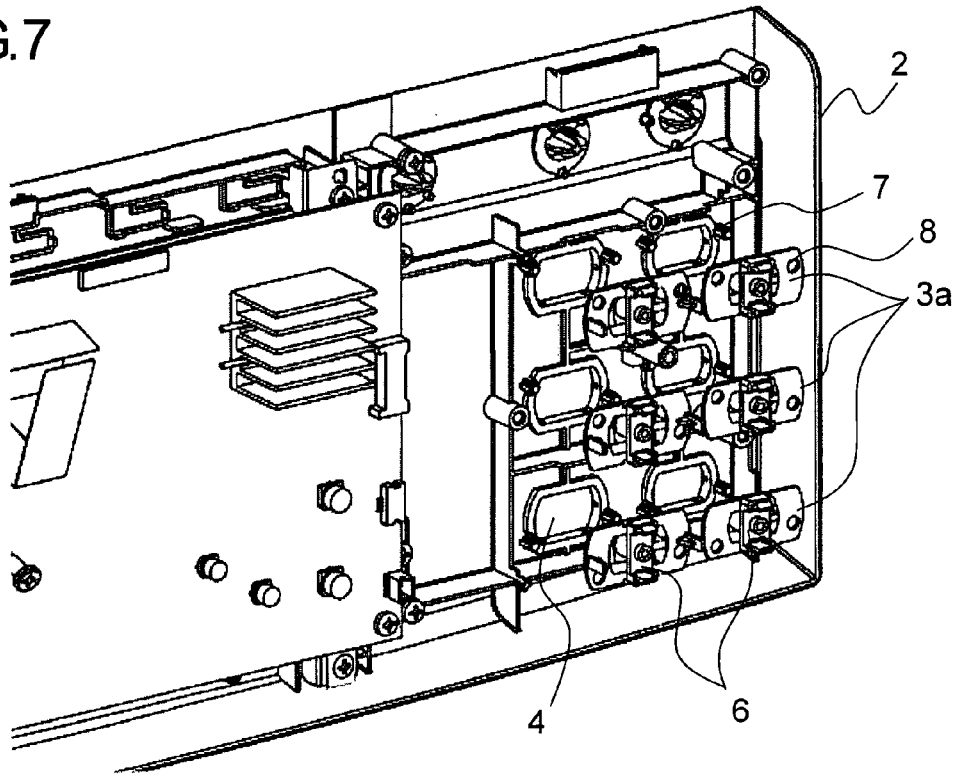
FIG. 7 is an exploded perspective view of the conventional operation panel as viewed from the rear side thereof.
Figure 8:
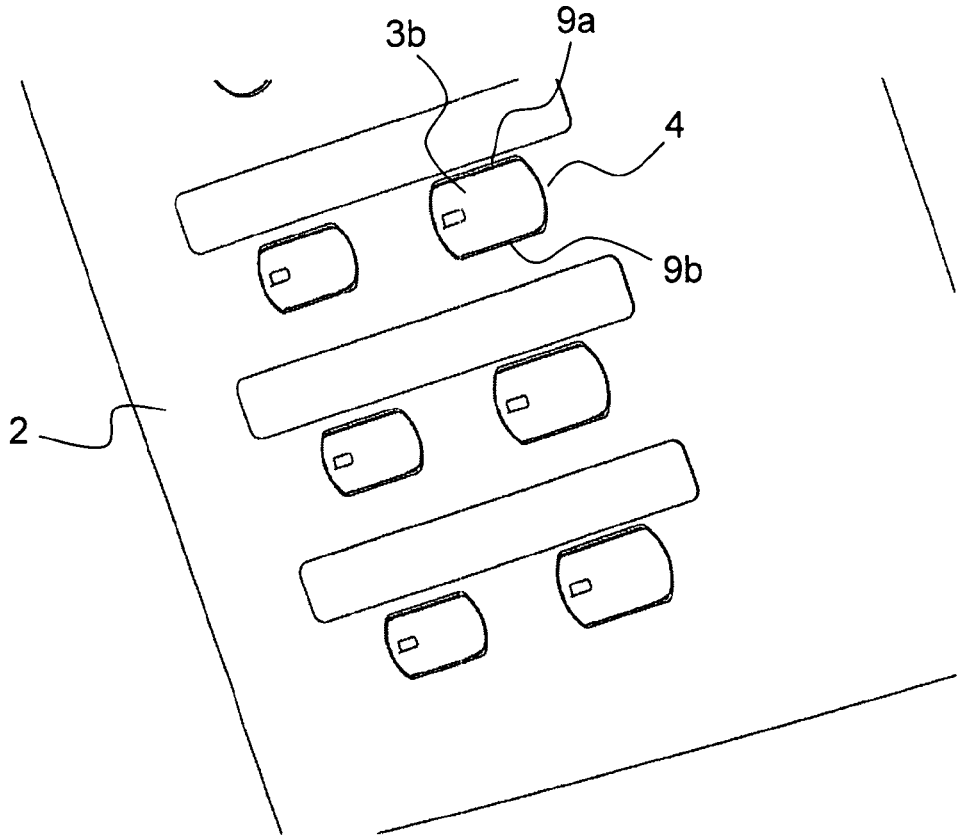
FIG. 8 is a partially enlarged view of an operation key portion of the conventional operation panel.

FIG. 2 is an exploded perspective view of an operation key portion of the operation panel of the invention as viewed from the rear side thereof. Portions in common with those in the conventional examples of FIGS. 6 to 8 are provided with the same numerals and thus omitted from the description. Here, three sets of two operation keys 3 are arrayed vertically in three lines, i.e., six operation keys 3 in total are arrayed. Boss holes 8 are formed at different positions for the different operation keys 3 arrayed in the lines. Of the operation keys 3 in each of the lines, those located on the left side as viewed from the rear side thereof are each provided with a rib 3*c* in a manner projecting from the rear surface of the flange section 3*a*. This unambiguously defines arrangement of the operation keys 3, preventing an error in fitting the operation keys 3 at assembly of the operation panel 1.

Between the operation key 3 and the operation section cover 2, film members 10*a* and 10*b* are arranged. At the position of the film members 10*a* and 10*b* coinciding with the guide holes 4, through holes 11 are formed. The operation keys 3 penetrate through their corresponding through holes 11 and guide holes 4 sequentially to project to the front of the operation section cover 2. These film members 10*a* and 10*b* permit the arrangement of the operation keys 3 at predetermined positions of the guide holes 4.

Figure 3:
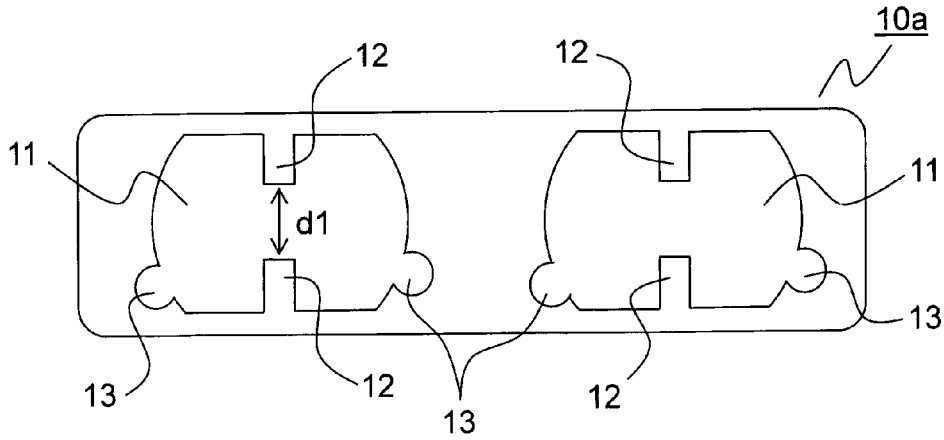
FIG. 3 is a plan view of a film member used for the operation panel according to the invention.

FIG. 3 is an enlarged view showing configuration of the film member 10*a*. The film member 10*a* has a pair of support pieces 12 provided in such a manner as to project inward from the vertical centers of the edges of each of the through holes 11. At two portions of the edge of the through hole 11, notches (openings) 13 are formed for the purpose of avoiding interference between the film member 10*a* and the bosses 7 of the operation section cover 2. An interval d1 between the tip ends of the support pieces 12 is set narrower than an outer dimension d2 (see FIG. 4) of the side surface of the operation key 3. Here, the configuration of the film member 10*a* has been described, but the same applies to the configuration of the film member 10*b* and thus its description will be omitted.

Next, a method of assembling the operation panel 1 of the invention will be described. First, with the notches 13 positioned in alignment with the bosses 7 on the rear surface of the operation section cover 2, the film members 10*a* and 10*b* are fitted such that the guide holes 4 and the through holes 11 coincide with each other. The alignment of the notches 13 with the bosses 7 in this manner permits easy positioning of the film members 10*a* and 10*b* and also permits prevention of displacement of the film members 10*a* and 10*b*. Next, the operation keys 3 are identified depending on the positions of the boss hole 8 and presence or absence of the rib 3*c* and then respectively fitted in the predetermined guide holes 4 through the through holes 11.

Figure 4:
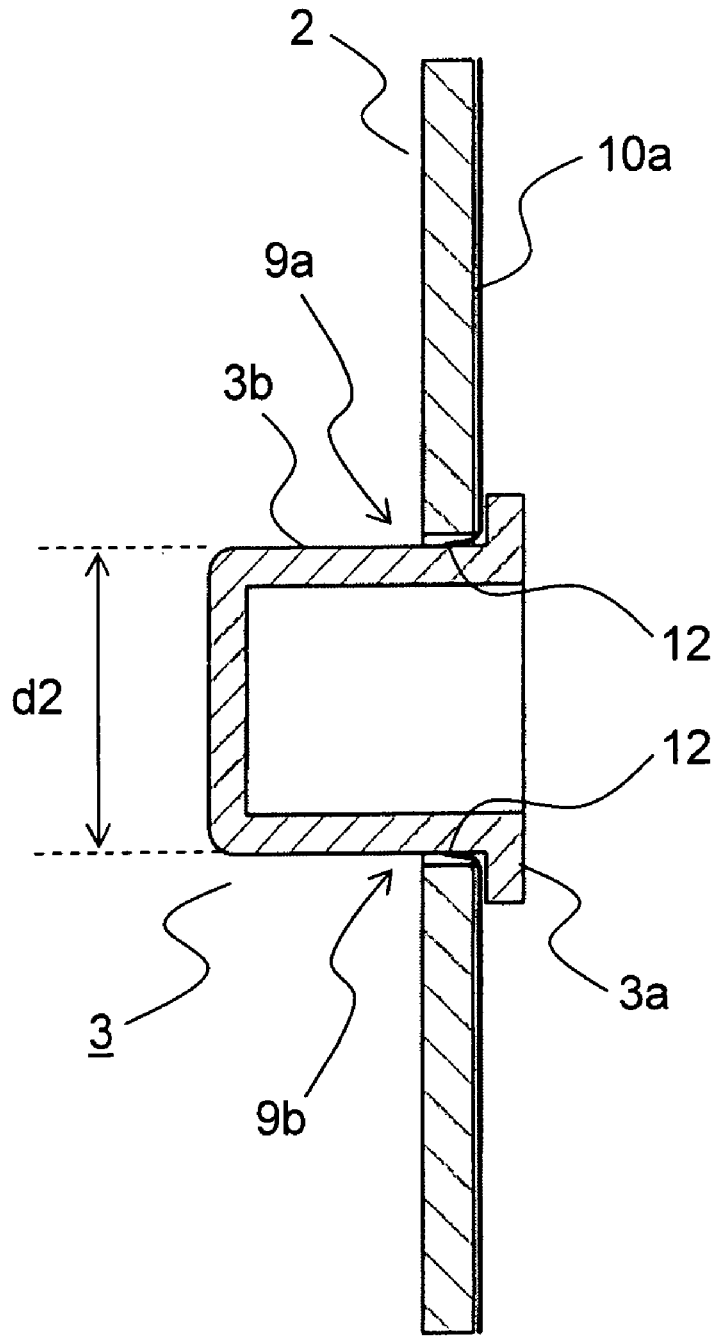
FIG. 4 is a longitudinal sectional view showing a condition that an operation key is fitted to an operation section cover according to the invention.

FIG. 4 is a sectional view showing a condition that the operation key 3 is fitted to the operation section cover 2. In FIG. 4, the operation section cover 2 tilts from the top to the bottom, and the support pieces 12 project in parallel to the direction in which the operation section cover 2 tilts. Since the operation key 3 is fitted in the guide hole 4 while making contact with the support pieces 12 of the film member 10*a*, the support pieces 12 are each pressed, widened, and then bent by the operation section 3*b*, thus sandwiching the operation section 3*b* from the top and the bottom. Here, the film member 10*a* has an elastic force possessed; thus, the operation section 3*b* is positioned at a substantially vertical center of the guide hole 4 by a restoring force of the support pieces 12 elastically deformed.

This configuration is free from a risk of deterioration in appearance caused by providing a sufficient clearance between the operation key 3 and the guide hole 4 and also reliably prevents locking of the operation key 3 caused by its interference with the edge of the guide hole 4. Moreover, this configuration, even in a case of tilted arrangement of the operation section cover 2, permits preventing widening of the clearance 9*a* on the top side caused by movement of the operation key 3 under the influence of own weight of the operation key 3, thus providing an operation panel compatible with a wide variety of designs.

A material used for the film members 10*a* and 10*b* is a flexible film having an elastic force, for example, a resin film of polyethylene terephthalate (PET), polyethylene, polypropylene, or the like. A polyethylene terephthalate film (Mylar film) in particular having small frictional resistance and an excellent elastic force is preferably used.

Too small thickness of the film members 10*a* and 10*b* results in a weak elastic force of the support piece 12 and provides insufficient advantage in positioning the operation key 3. Too large thickness thereof results in a too strong elastic force of the support piece 12, resulting in failure to smoothly operate the operation key 3. Thus, optimum thickness can be set in accordance with the specifications of the operation panel 1, such as the shape and size of the operation key 3. Note that the elastic force of the support piece 12 can also be adjusted by the degree and width by which the support piece 12 projects.

Figure 5A:
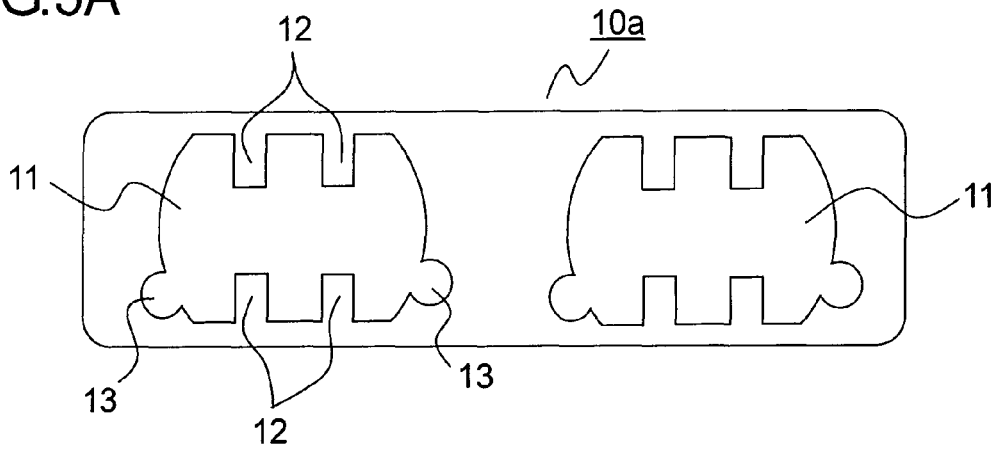
FIG. 5 is a plan view showing another configuration example of the film member used for the operation panel according to the invention.
Figure 5B:
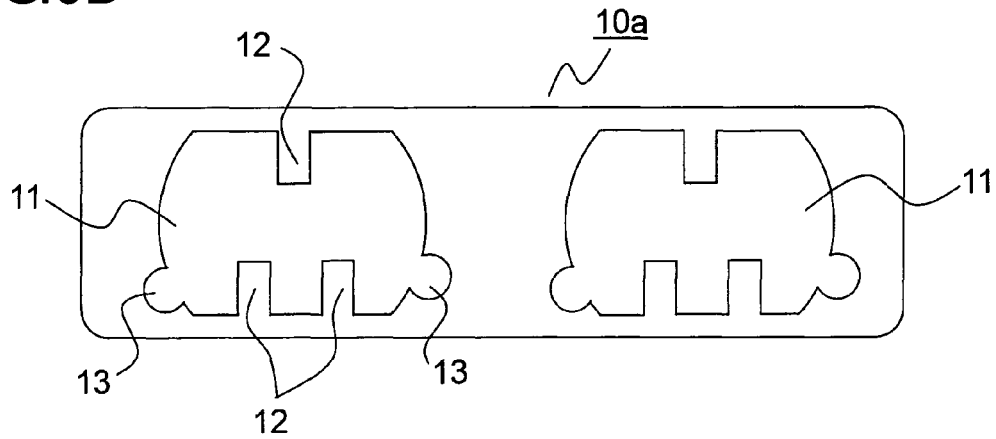
Figure 5C:
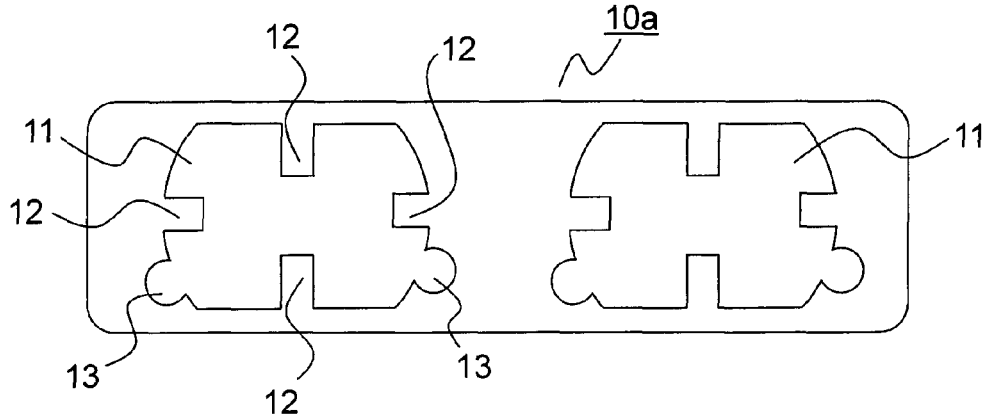

FIGS. 5A to 5C are plan views showing other configuration examples of the film member used in the operation panel of the invention. In FIGS. 5A to 5C, the film member 10*a* is provided as an example, but exactly the same description applies to the film member 10*b*.

In FIG. 5A, support pieces 12 mutually opposing at the top and the bottom are provided parallelly in two pairs. Consequently, compared to the configuration of FIG. 2 in which one pair of support pieces 12 are provided, the operation key 3 can be stably arranged and also an elastic force acting on the operation key 3 can be enhanced. As shown in FIG. 5B, the number of support pieces 12 may differ between the top and bottom of the through hole 11. With the configuration of FIG. 5B, the elastic force acting from the support piece 12 on the operation key 3 differs between the top and the bottom, which is advantageous when it is required to enhance the elastic force at the bottom to which load as own weight of the operation key 3 is added, for example, in cases such as where the operation section cover 2 is so arranged as to tilt at a steep angle.

As in FIG. 5C, support pieces 12 can be provided on the left and right, in addition to the top and bottom of the through hole 11. This configuration can prevent horizontal displacement of the operation key 3, and can also provide, on the left and the right, a uniform clearance between the operation key 3 and the guide hole 4, thus resulting in the operation panel with even better appearance.

Loading the operation panel 1 of the invention in an image forming apparatus as shown in FIG. 1 provides the easy-to-use image forming apparatus which does not encounter locking of the operation key, which has a less outstanding clearance around the operation key, and which is excellent in design.

Other aspects of the invention are not limited to the embodiment described above. Thus, various modifications can be made within a range not departing from the spirit of the invention. For example, in the embodiment described above, the film members 10*a* and 10*b* as two separate members are arranged between the operation section cover 2 and the operation keys 3. As alternative configuration, for example, one film member may be arranged for each of the operation keys 3, or one film member may be arranged for all the operation keys 3.

Here, the image forming apparatus has been illustrated as an electronic device loaded with the operation panel 1. The operation panel of the invention may also be, needless to say, loaded in other electronic devices, such as a personal computer, TV, an audio instrument, and the like.

The invention refers to an operation panel including an operation key which makes contact with and separates from a contact on a control board and an operation section cover provided with a guide hole from which part of the operation key projects. In the operation panel, input operation on an electronic device is performed by pressing the operation key.

In the operation panel, to the rear surface of the operation section cover, a flexible film member is fitted which has: a through hole coinciding with a guide hole and a plurality of support pieces formed at opposing edges of the through hole and elastically deformed as a result of insertion of the operation key in the through hole to thereby make contact with the side surface of the operation key.

As a result, the operation key is positioned by the elastically deformed support pieces without making contact with the edges of the guide hole. This permits providing an operation panel which is capable of reliably preventing locking of the operation key and maintaining a uniform clearance between the operation key and the guide hole and also which is excellent in design.

At least one pair of support pieces are provided so that the tip ends thereof oppose each other. This permits providing a uniform elastic force acting from the support pieces on the operation key, which in turn permits positioning of the operation key at a substantially center of the guide hole.

Loading the operation panel of the invention in an electronic device such as a copier, a printer, or the like results in the electronic device which is excellent in both operability and design. Further, to tilt the operation panel to fit it to the electronic device, bringing the support pieces into contact with the side surface of the operation key which side surface is oriented vertically with respect to the tilt permits prevention of downward movement of the operation key and also provides the electronic device also compatible with a universal design.

What is claimed is:

1. An operation panel comprising:

an operation section cover provided with a guide hole penetrating the operation section cover in a front and a rear direction;

an operation key projecting forward from a rear surface side to a front surface side of the operation section cover with a predetermined interval secured between the operation key and an opening edge of the guide hole; and a flexible film member fitted to a rear surface of the operation section cover, the flexible film member having a through hole that coincides with the guide hole and is larger than an exterior size of the operation key, and a plurality of support pieces formed at a part of opposing edges of the through hole and elastically deformed by insertion of the operation key in the through hole to thereby make contact with a side surface of the operation key such that the support pieces project forward through the guide hole and are oriented between the side surface of the operation key and inside edges of the guide hole, wherein an input operation is performed by pressing the operation key.

2. The operation panel according to claim 1, wherein the support pieces are provided in at least one pair so that tip ends thereof oppose each other.

3. The operation panel according to claim 2, wherein the support pieces are provided in at least two pairs so that the support pieces make contact with the side surface of the operation key from different directions.

4. The operation panel according to claim 1, wherein the film member has a plurality of the through holes.

5. The operation panel according to claim 1, wherein the film member has an opening formed into a shape substantially identical to a shape of a boss of the operation section cover, the opening being located at a position coinciding with the boss.

6. The operation panel according to claim 1, wherein the film member is formed of a polyethylene terephthalate film.

7. An electronic device loaded with the operation panel according to claim 1.

8. The electronic device according to claim 7, wherein the operation panel is so fitted as to be tilted at a predetermined angle with respect to a horizontal plane, and wherein the support pieces make contact with the side surface of the operation key, the side surface being vertically oriented with respect to the tilt of the operation panel.

* * * * *